United States Patent [19]

Naramore

[11] 4,385,827

[45] May 31, 1983

[54] HIGH SPEED DUPLICATOR WITH FINISHING FUNCTION

[75] Inventor: Raymond A. Naramore, Penfield, N.Y.

[73] Assignee: Xerox Corporation, Stamford, Conn.

[21] Appl. No.: 254,344

[22] Filed: Apr. 15, 1981

[51] Int. Cl.[3] ..... G03G 15/00

[52] U.S. Cl. ..... 355/14 SH; 271/287; 271/292; 355/3 SH

[58] Field of Search ..... 355/3 SH, 14 SH, 14 C; 270/58; 271/287, 290, 288, 294, 296, 297, 292; 414/52, 43

[56] References Cited

U.S. PATENT DOCUMENTS

| | | | |
|---|---|---|---|
| 3,995,748 | 12/1976 | Looney | 271/294 X |
| 4,134,672 | 1/1979 | Burlew et al. | 355/14 |
| 4,248,525 | 2/1981 | Sterrett | 355/14 |

OTHER PUBLICATIONS

IBM Technical Disclosure Bulletin, vol. 18, No. 9, Feb. 1976, p. 2807.

IBM Technical Disclosure Bulletin, vol.18, No. 10, Mar. 1976, pp. 3160–3161.

*Primary Examiner*—R. L. Moses

*Attorney, Agent, or Firm*—Bernard A. Chiama

[57] ABSTRACT

A collation/finishing system is disclosed for use with a very high speed, fully automated reproduction machine having a document handling apparatus, copy sheet processor, and a finishing station. In this arrangement, a sorter bin array is arranged to receive copy sheets on one side and to collate the copy sheets into copy sets corresponding to a multiple page document. A set transport is arranged on the other side of the bin array for unloading the completed copy sets. The bin array is indexed in either direction to either receive copy sheets or to permit unloading.

3 Claims, 7 Drawing Figures

PROGRAMER LOGIC AND MICROPROCESSOR
PROCESSOR
XEROGRAPHIC PROCESSING
SHEET FEED
INPUT STATION
FLASH ILLUMINATION
ADH
SWITCHES AND SENSORS S-1, SR-1 SR-2
DRIVER
ELEVATOR DRIVE
FINISHING STATION
SERVO CONTROL
GATES 103, 130
POWER AMP
VALVE 128
STAPLER DRIVE
STAPLER CLAMPING
STAPLER CLINCHING
SET TRANSPORT MOTOR M-2
INDEX MOTOR M-1

HIGH SPEED DUPLICATOR WITH FINISHING FUNCTION

This invention relates to an improved finishing station for use with a reproduction system.

With the advent of higher speed and more sophisticated copy producing machines, printing presses, and the like, considerations as to how the mass of copies generated can best and most effectively be handled, has assumed increasing importance. One way has been to provide a reproduction system with an input device in the form of a recirculating document handling apparatus. In this system, a document sheet is removed from a collated set of document sheets, placed on an exposure platen for exposure at the rate of one exposure for each document sheet, and returned to the top of the set in the document handling apparatus until the set of document sheets has been completely circulated through the apparatus, and a copy set has been produced. The set of document sheets is then recycled for the reproduction of a second copy set, and so on. After each copy set is produced and collected at a collection station, a finishing device such as a stitcher is activated to bind the set.

These systems are of the pre-collation type wherein the document sheets are precollated in the document handling apparatus prior to commencement of a reproduction run. The output for the reproduction machine will likewise be precollated in sets corresponding to the sequenced numbered document set in the document handling apparatus. The copy sheets are collected in collated sets as they are sequentially produced so that binding may be effected without the interaction of additional devices. Such systems are described in U.S. Pat. No. 4,134,672.

One of the disadvantages in these systems having continuous document recirculation to produce each bound copy set is that for compilation of each copy set and eventual stapling or stitching, many moving parts have been required and have added to the risks of unscheduled maintenance. In addition, generally, in providing for the stapling or stitching step, a varied number of machine pitches per set may be lost thereby reducing productivity for the system.

In order to achieve still higher rates of production of finished copy sets, the present invention contemplates the concept of utilizing post-collation rather than precollation. The inventive arrangement utilizes document handling wherein a predetermined number of light images are produced for each document sheet, say for example, of page one of a multi-page document, before a successive document sheet, perhaps page two of the document, is likewise imaged. This sequencing in turn may be repeated many more times if a very large number of copy sets are to be reproduced. In this manner, the mechanical movements involved in document handling are held to a minimum. As the copy sheets are being produced in accordance with the above imaging procedure, a single array of collecting bins or sorter is held stationary for the first block of copy sets to be produced and arranged to receive the copy sheet output for collating the same into complete sets by means of a vertically arranged transport. This transport is positioned to load copy sheets on one side of the array of bins. For at least the last copy sheet of the sets, the array is indexed vertically to receive the last sheet.

As the array is being so indexed, each completed set is removed from a bin sequentially by means of a set transport positioned on the side of the array opposite that of the vertical transport to permit unloading on this side. A finishing device such as a stitcher or stapler is positioned adjacent the set transport and activated to apply a staple to each completed set.

This arrangement is different from that disclosed in U.S. Pat. application Ser. No. 180,184, filed Aug. 21, 1980, and commonly assigned in that the present invention loads copy sheets and unloads copy sets on different sides of the array. In addition, the present invention utilizes a pivotal set transport arranged to grip a copy set from each bin as the array is indexed and to carry the copy set to a stapler for finishing and upon de-activation directly to a collecting elevator. In the earlier filed, above-referred-to application, loading and unloading is effected on the same side of the array. With the present arrangement, maximum throughput is available from the various apparatus utilized in the reproduction system. In the present arrangement, there is no lost productivity due to the bin array not being in the right position for unloading when the last sheet is sorted as is the situation in the system disclosed in the above-referred-to application.

The present arrangement is similar to that disclosed in U.S. Pat. application Ser. Nos. (D/80285), and (D/80289), filed concurrently herewith. In both of these applications, a set transport is utilized on the same side of the sorter array as loading of copy sheets is provided, and therefore additional indexing steps may be needed and copy cycles or "pitches" are lost during some phases of production runs. The present effort is accomplished with a minimum of moving parts, less wear and tear, less down time or maintenance for the apparatus utilized. In addition, the present arrangement offers a more economical system since sorter indexing noise is lower and there is lower power requirements. More productivity is possible because the last copy sheet is always fed while the sorter is moving downwardly regardless of the number of document sheets thus avoiding wasted time without this feature.

PRIOR ART

In the IBM Technical Bulletin, Vol. 18, No. 9, September 1976, page 2607, a collator-stapler apparatus is disclosed having a stationary array of angular-disposed bins which are loaded on one side and arranged for unloading on the other side. Unloading is accomplished by opening gates associated with the bins and permitting the sets to fall by way of a chute to a stapler station.

In the IBM Technical Disclosure Bulletin, Vol. 18, No. 10, March 1976, pages 3160–3161, a collator-stapler mechanism is disclosed as having a single array of collating bins which are held in fixed position while a traveling clamp moves along to pick up a copy set from each bin and to convey the same to a jogger and then a stapler.

U.S. Pat. No. 4,248,525, illustrates and describes a copy system having a document handler 12, a copy processor, copy storage section 14, and a finisher 16. Ordinarily, the section 14 functions in the manner of a stacking device wherein each bin collects all of the copies of a document sheet either manually or in combination with the handler 12 and is not utilized as a collator. However, the system can be programmed so that the section 14 functions as a conventional collator. There is no provision for coordinating or integrating this function with that of a finisher to arrive at high speed continuous collating and finishing.

Present day machines on the market, such as the Xerox duplication machines labeled the 9400 Duplicator and the 9500 Duplicator marketed by Xerox Corporation of Stamford, Conn., utilize a document handler as an input device which exposes as many copies of a single document sheet at a time as is appropriate before starting on the next document sheet. Any other suitable type of automatic document handler may also be used in conjunction with the processor for the 9400 or 9500 Duplicators.

It is therefore the principal object of the present invention to produce bound sets or stacks of copies of a multi-page document at the highest speed possible for a reproduction machine.

It is a further object of the present invention to maintain full productivity in a reproduction/finishing system by eliminating those machine copy cycle pitches which are wasted during some machine operating steps.

It is another object of the present invention to minimize the number of moving parts in a finishing station and to reduce the number of movements usually incurred during the operation thereof.

The present invention is directed to a finishing apparatus for binding copy sheets received in succession at a sheet collecting device, comprising a single bin array, having a series of individual vertically arranged bins each with an inlet on one side of the array for receiving individual sheets from a sheet transport which conveys each sheet vertically to the bins in succession. Means are provided for indexing the array in a vertical direction for the sequential disposition of a selected ones of the bins, at a copy set unloading position. A pivotal set transport means is also provided for removing each set of collected copy sets from the bins at the unloading station, opposite the side of the bin array from the sheet receiving inlet. While the array is being moved vertically for unloading, it is adapted to receive the last sheet of the sets being produced or the first sheets of another block of copy sets to-be-produced. Stapling means for binding each set after removal from the sorter array is arranged to receive each set from the set transport.

While the invention is disclosed in combination with a reproduction machine of the electrostatographic type, it will be understood that the disclosed collating system may be combined with other printing apparatus or machines which merely sort, collect and/or effect the movement of informational items such as sheets or cards.

Other objects and advantages will be apparent from the ensuing description and drawings wherein.

Figure 1:
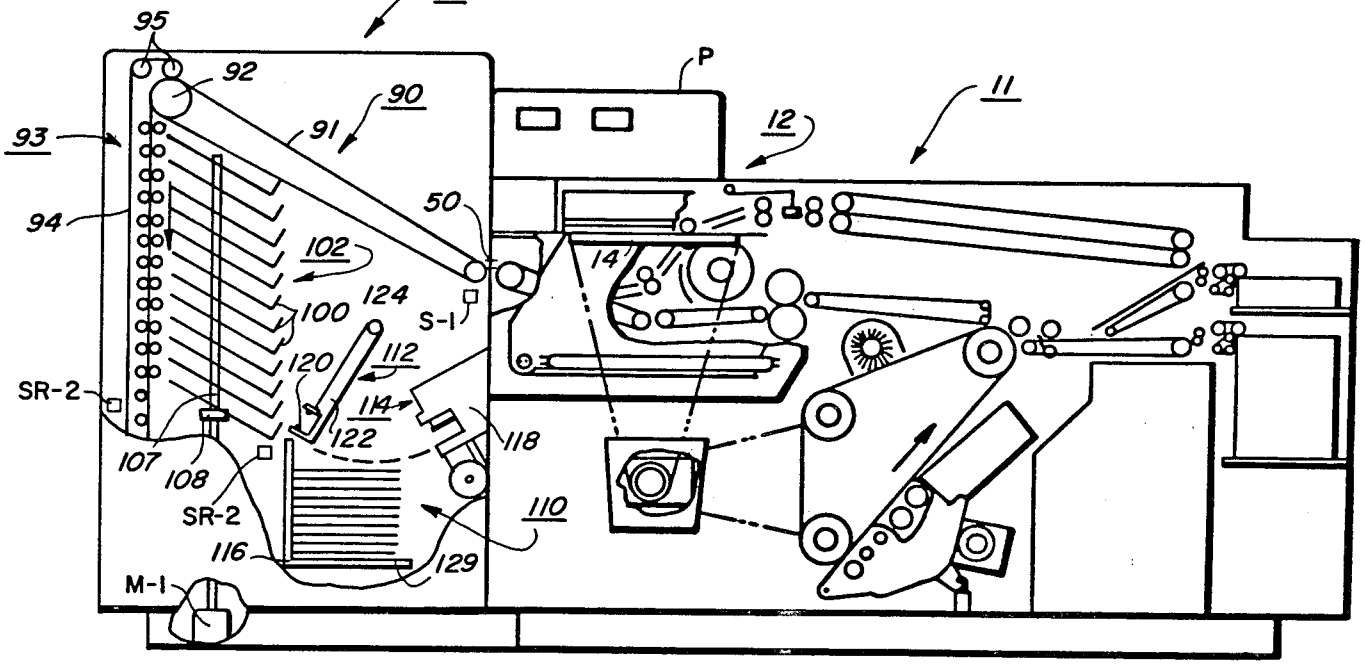
FIG. 1 is a schematic illustration of a configuration of an electrostatographic printing/finishing system employing the present invention.
Figure 4C:
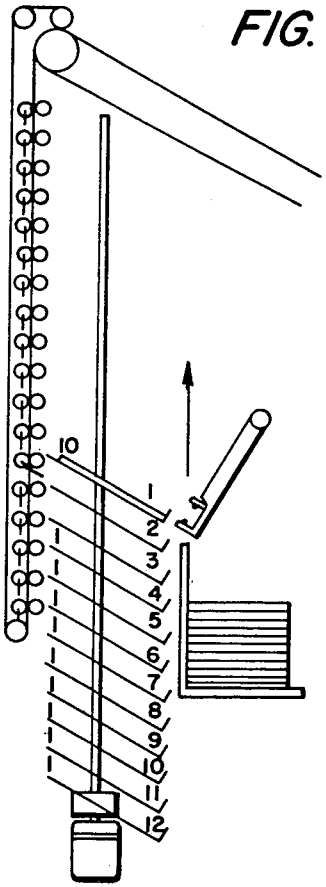
Figure 4B:
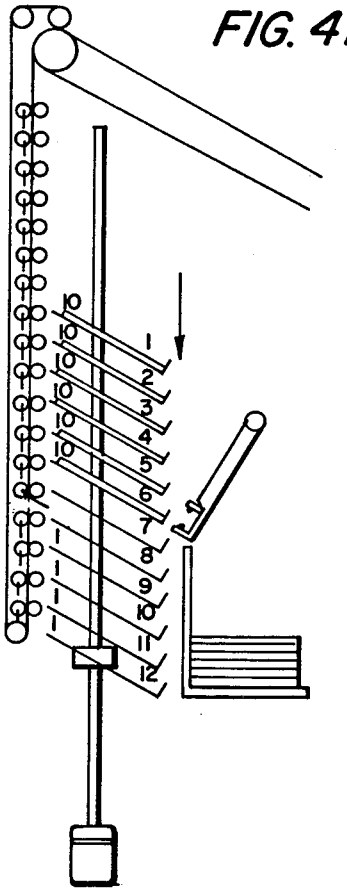
Figure 4A:
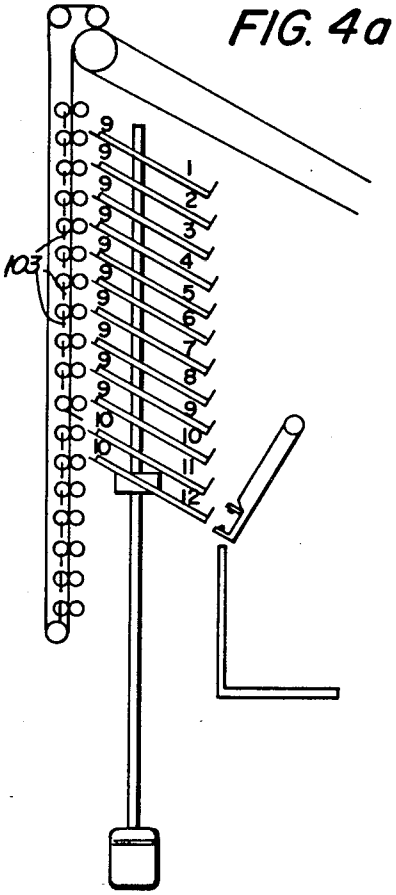
Figure 5:
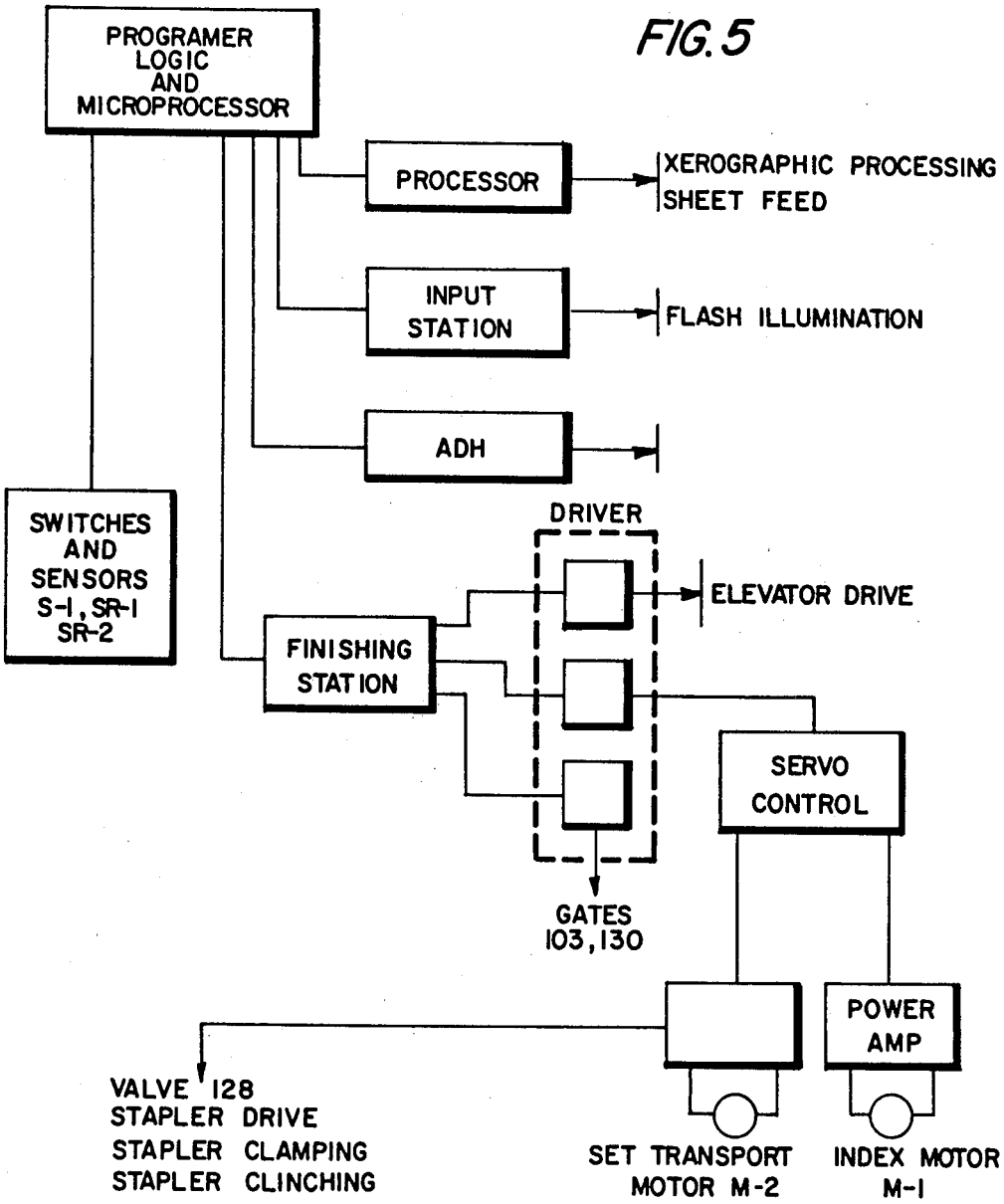

FIGS. 4(*a*) to 4(*c*) illustrate a sequence of events in the finishing of sets of copy sheets; and FIG. 5 is a block diagram of the control scheme for the printing system of FIG. 1.

For a general understanding of a reproduction machine with which the present invention may be incorporated, reference is made to FIG. 1 wherein components of a typical electrostatic printing system are illustrated. The printing system is preferably of the xerographic type as one including a xerographic processor 11, and an automatic type document handling apparatus 12. Preferably, the processor 11 is the same as the processor in the commercial embodiment of the Xerox 9400 Duplicator, which utilizes flash, full frame exposure for very high speed production. Document sheet exposure, image processing and copy sheet transport/handling are under control by a machine programmer and are effected in timed sequence, and in accordance with the program an operator has preset in the machine. Further details in this regard are not necessary since the Xerox 9400 Duplicator operates in this manner as is well known. Details of the timing relationships, the programmer, and related structure and events are described in U.S. Pat. Nos. 3,790,270; 3,796,486; and 3,917,396, commonly assigned and which are incorporated by reference. It will be understood that most any other type of xerographic processor and document handling apparatus may be utilized. Operating in conjunction with the processor 11 and apparatus 12 is a finishing station 13 and thereby forms the reproduction system shown in FIG. 1.

The system comprising the processor 11, the document handling apparatus 12, and the finishing station 13, is under control of a programmer P which permits an operator various options: to turn the entire system ON or OFF; to program the reproduction system for a desired number of reproductions to be made of each original document sheet or set; to select whether simplex or duplex copies are to be made; to select a desired output arrangement, that is, sets mode or stacks mode, stapled or unstapled; to select one of a plurality of paper trays; to condition the machine for the type of document, that is, whether one sided or two sided, to select a copy size reduction mode, and other desirable functions. The programmer P also includes a controller which provides all operational timing and synchronization between the processor 11 and all of its xerographic processing functions, and system control functions, the automatic events to be described hereinafter. The controller may include any suitable microprocessor having a CPU and the appropriate machine clock, but preferably the microprocessor is one similar to the Intel 8080 Microprocessor manufactured by the Intel Corporation, Santa Clara, Calif., and having sufficient ROM's and RAM's for all of the necessary functions in the reproduction system.

The document handling apparatus 12 serves to feed one document sheet D at a time from a supply of document sheets into copying position on the platen 14 where a single exposure of only one copy set is programmed, or a plurality of exposures may be made. Following exposure one or more times, each document sheet is automatically returned to the document supply and the next document sheet, if any, is brought into the exposure position on plate 14. Document sheets returned to the supply stack may be recycled by the apparatus 12 or simply removed by the user when the copying program is completed. Since the particular document apparatus 12 is a commercial device being part of Xerox Corporation's product labeled the 9400 Duplicator, and a variation of the same is adequately described in U.S. Pat. No. 3,944,794, which is incorporated by reference herein, further description thereof will not be included herein.

Further details of the processing devices and stations in the printer system or processor are not necessary to understand the principles of the present invention. However, a detailed description of these processing stations and components along with the other structures of the machine printer are disclosed in U.S. Pat. No. 4,054,380 which is commonly assigned with the present invention and which is incorporated by reference herein.

As previously described, a document apparatus 12 includes a document tray adapted for supporting a stack comprising a plurality of document sheets in numbered sequence with page one of the multi-page document on the bottom of the stack. Since the illustrated document handling apparatus is of the bottom feeder type, page one will be the first document sheet imaged, and so on.

For either the simplex or duplex modes of operation, copy sheets exiting the exit slot 50 positioned at one end of the housing for the xerographic processor 11 are directed to the finishing station 13 which comprises a sorting or collating mechanism, a stapler apparatus, and an output elevator system. After leaving the processor 11, each sheet is positioned upon a transport 90, is registered thereon and further conveyed generally along an ascending path of movement by means of a transport belt 91 which is trained around a roller 92. The belt 91 may be driven by a motor and suitable gearing and pulleys (not shown) at a speed slightly greater than the processing speed of the processor 11 in order to add more working space between the sheets and to ensure that the final handling of copy sheets does not impede the throughput of the entire system as determined by the process speed.

At the exit slot 50, a sheet-contacting switch S-1 is positioned to be actuated as each sheet enters the transport 90 of the finishing station 13. The circuit for this switch is connected to the logic in the programmer P and serves to reset the machine clock for the finishing function so that zero time for the sheet commences when the sheet trips the switch S-1.

Figure 2:
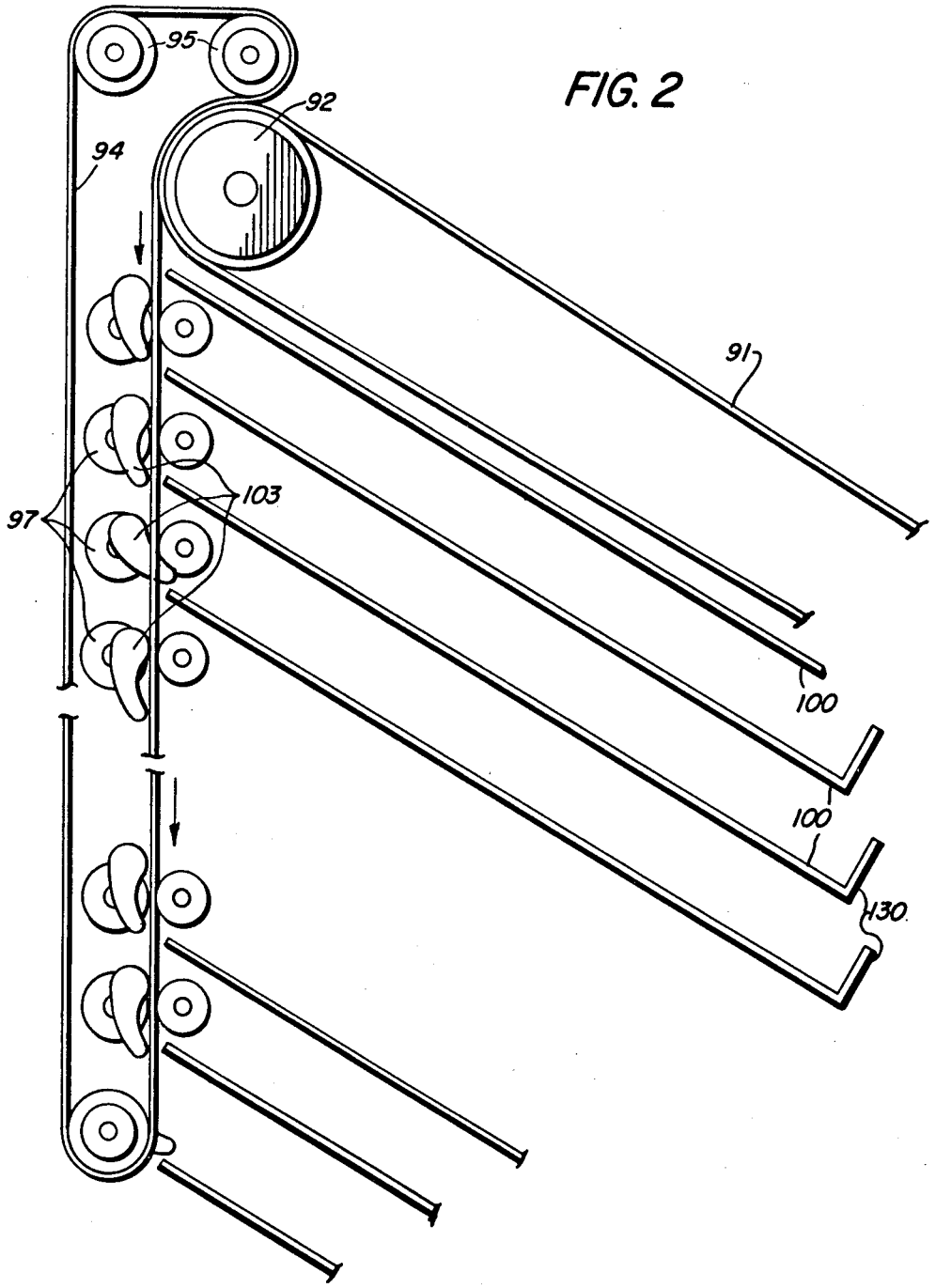
FIG. 2 is a partial cross-sectional view of the gated transport apparatus utilized with the present invention.
Figure 3:
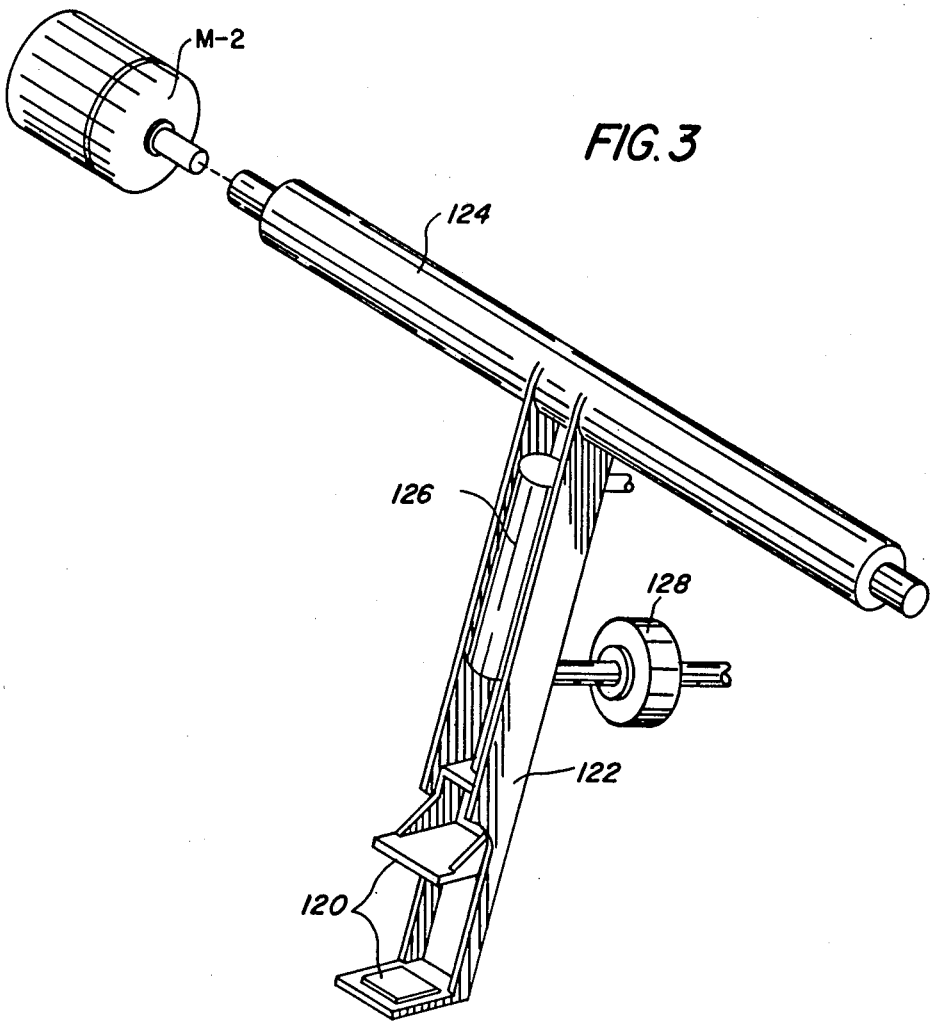
FIG. 3 is an isometric view of the set transport mechanism utilized with the present invention.

As shown in FIGS. 1 and 2, the upper end of the transport 90, at the roller 92 cooperates with a conveyor belt mechanism 93 of the gated transport type positioned to receive copy sheets from the transport belt 91 and to apply them upon a belt 94 for the mechanism. The belt 94 is entrained around two pulleys 95 at the uppermost end of the transport 93 and partially surrounds the roller 92 being in contact with the belt 91 at this point. Each copy sheet is transported between the belts 91, 94 around the pulley 92 and then along with the belt 94. The belt 94 cooperates with a plurality of rollers 97 for transporting copy sheets vertically downwardly past the open ends of a array of collecting bins 100 for a sorter generally indicated by the reference numeral 102. A deflector or gate 103 is associated with each of the bins 100 for directing a sheet into a bin when a deflector or gate 103 has been pivoted to a position to deflect a sheet into the associated bin. A suitable solenoid (not shown) may be utilized with each of the gates for causing deflection thereof and the programmer P may include the control circuitry for effecting the timed sequence of their operation in accordance with a program selected by the operation.

In the illustrated embodiment, the array 102 includes twelve angularly disposed bins 100 arranged in a vertical stack, the number of which corresponds to the predetermined number of exposures made of each document sheet while it is on the platen 14. The number of bins utilized should correspond to the total number of sheets in the paper path when the system has been programmed for the duplex mode so that no machine "pitches" are skipped. The number of exposures made for each document sheet positioning on the platen also corresponds to this total number of sheets, which for the illustrated machine is twelve sheets.

The belt 94 may be driven by any suitable means in the direction indicated by an arrow in order to permit collation of copy sheets into the bins 100 as the gates 103 are actuated either sequentially or at some program designated sequence. The sequence of loading or collecting sheets starts with the bottommost bin and progresses to the topmost bin. Further details of a gated transport are unnecessary as these are known in the art and are provided in the sorter modules associated with the Xerox 9400 Duplicator. U.S. Pat. No. 3,709,492 discloses such transports, except the orientation which for the patented system is horizontal rather than vertical.

The array 102 is mounted for bi-directional vertical movement within a suitable supporting fixed frame and, as shown in FIG. 1, the array is positioned in its normal standby position.

As will be described hereinafter, a set binding apparatus in the form of a stapler apparatus is arranged for activation on the other side of the array 102 from the side whereat sheets are transported or loaded into the bins. This apparatus includes means to remove or unload completed sets of collated copy sheets from each bin and to effect single or dual stapling along an edge of the set if so programmed or no stapling at all, and finally to position the stapled or unstapled sets on an elevator mechanism. In order to permit complete removal of the sets from all of the bins 100 in the array 102, the array is arranged for indexing in either vertical direction one bin at a time to permit removal of the sets from the bins.

In the normal operating set mode, the sorter/finishing arrangement handles a block or number of sets at a time equal to the number of sheets in the paper path when the system is in the duplex mode (typically a block of twelve copy sets). In this example, the document handling apparatus 12 exposes each document sheet twelve consecutive times before advancing to the next document sheet until the complete set of document sheets in a document thereof has been exposed. If more than twelve copy sets have been programmed, the document apparatus/sorter finisher system will complete the reproduction run in blocks of twelve copy sets.

The system will continue to sort and automatically unload in blocks of twelve sets until the programmed number of sets is completed. In producing twelve copy sets at a time, there are twelve bins 100 in the array 102 and eighteen deflectors 103. If the system was based on producing eight copy sets at a time, then eight bins would be utilized with twelve deflectors, and so on.

The bin array 102 is indexed vertically in either direction by a drive screw 107 connected to the shaft of a servo motor M-1 which is mounted to the base of the frame for the machine. These movements of the array are effected by a threaded ball member 108 secured to the frame for the array and through which the screw 107 is threadedly related. Rotation of the screw (which is fixed against axial movement) in either direction will impart corresponding up or down movement of the ball member 108 and consequently the array. Further details of the bin array structure is not necessary as these details are disclosed in the above referred to U.S. patent application. Any other drive apparatus may be utilized for indexing the array, such as pulleys and cables driven by suitably arranged fluid drive systems.

After copy sheets, simplex or duplex, have been produced in the processor 11, transported by the transport 90 and collected in the bin array 102 while the system is in either the sets mode or the stacks mode, the collected sets are not in condition to be further processed by a finishing apparatus generally indicated by the reference number 110. Actually, as will be discussed below, during the last series of indexing movement of the bin array whether it is moving to either of its extreme positions, copy sets removal for the finishing action may take place simultaneously with collection of copy sheets.

The finishing apparatus 110 comprises three subassemblies each of which is programmed to operate in timed sequence with each other, with the system logic and programmer P, to be timed relative to the number of sets and copy sheets per set which were previously pre-programmed by an operator, and with the document sheet actuation of the apparatus 12. As shown in FIG. 1, the finishing apparatus comprises a set transport 112, individually-operable, dual stapler apparatus 114, and an elevator 116.

The set transport 112 is utilized to unload sets of stacks of copy sheets automatically from the bins as the same move vertically in either direction, depending upon whether there is an odd or even number of copy sheets per set, and in the finishing sequence. The set transport includes copy set clamping jaws 120 mounted at the lower end of a pivotal arm 122 mounted for limited pivotal movement in both directions by a shaft 124 wherein the jaws 120 are adapted for cyclic swinging action in pendulous motion. Clamping of the jaws 120 is achieved by a pneumatic actuator 126 connected to a suitable source of air pressure by way of a control valve 128 and arranged to move one of the jaws toward the other. The control valve may be operatively associated with the programmer P by way of logic and control circuitry in order to effect clamping of a copy set and release thereof in proper timed sequence and in timed relationship to other events during unloading of the copy sets and stapling thereof.

The stapler apparatus 114 provides a stapling function either with a single staple or with two staples, both being adapted to be applied at various positions along a long edge of a set or stack of copy sheets. Stapling is achieved by way of two identical mechanisms, each of which provides the function of set clamping, staple driving, and staple clinching. Preferably, the apparatus utilizes two commercial type stapler heads 118, such as the Bostitch staple head indicated as the 62-E manufactured by the Bostitch Division of Textron Corporation of Providence, R.I. The kicker mechanism (not shown) is utilized to push or kick stapled sets from the stapler apparatus 114 and permit dropping of the set onto the elevator 116. The operation of the kicker mechanism can be timed for actuation by means of the programmer P so as to be activated in timed sequence immediately after staple clinching and jaw opening.

The elevator 116 is utilized to collect into a pile the stapled or unstapled sets or stacks of copy sheets for delivery to the operator. The elevator comprises a tray assembly 129 mounted for vertical movement in either direction by a suitable drive mechanism, not shown. Elevator height of piled sets or stacks is controlled by an optical sensor SR-1 which "looks" across the stack and effects the energization of the elevator motor and lowering of the tray 119 until the pile is below the sensor. A second sensor (not shown) may be positioned to sense the lowermost position of the elevator tray 119 whereat the tray is considered at full capacity.

Each of the bins 100 is provided with a pivotal gate 130 which serves to hold copy sheets in the bins during collection and to register the sheets prior to stapling. All of the bins have scuffers for corner registration with the gates 130 defining one of the edges of the corner. At the proper time, as determined by the programmer P, the gates 130 are activated to open positions in timed sequence to permit the jaws 120 to enter the bins and clamp the adjacent edge of a copy set. After clamping, the jaws are swung away from the bin being loaded and pivoted to bring the clamped edge into stapling position relative to the apparatus 114.

For ease of understanding later description, the bins are numbered consecutively from one to twelve starting at the lowest bin with bin numbered twelve at the top of the array. For the first cycle of operation in producing copy sets, the array is held stationary during collating of copy sheets for all but at least the last sheet of each set of copy sheets being collected, and is indexed in either the downward or upward direction past the unloading station adjacent the jaws 120 for the sequential unloading of copy sets as the last copy sheet is being loaded. A suitable sensor SR-2 may be positioned at the front edge of the lowermost bin to indicate to the system logic that this action has occurred. In addition, as the array indexes, for the unloading of completed copy sets, the set transport 112 unloads a set from the array at the rate of movement of two copy sheets through the transport 93, that is, indexing for unloading sets sequentially from each bin occurs while two bins are being loaded with copy sheets. When the proper number of copy sheets have been loaded for the particular block of copy sets being unloaded, copy sheets from the next block of copy sets being produced will begin being collected so that there is no losses of pitches during the production run.

In FIGS. 4(*a*)-(*e*), there is shown sequences of collating and finishing events for a document having ten document sheets. In these instructions, the vertical column of numbers one to twelve at the right of each sequence indicate the bin number and the left hand vertical column of numbers indicate the last copy of the document sheet being collected. As previously stated, it is assumed that the document handling apparatus 12 is programmed to place a document sheet upon the platen 14 and to effect twelve exposures of the document sheet before the removal of the document sheet and placement of a succeeding document sheet, and so on. This assumption also corresponds with the number of bins in the array 102 wherein each copy sheet produced during the exposure of a document sheet on twelve occurrences is received in a bin. The transport 93 has a total of 18 deflectors 103, six more than the number of bins 100.

In our example, it will be assumed that a document to be copied has ten document sheets and that twenty-four copy sets are programmed in the programmer P to be produced. The first nine pages of each copy set have been loaded into the array 102 starting from the bottom using the upper twelve deflectors 103 by means of the belt 94 in cooperation with the transport rollers 97 and while the array 102 is held stationary. Page ten is fed to the bottom bin first and then in sequence to the other eleven bins just as the first nine sheets had been. After page ten is loaded into the bin numbered eleven, the twelfth bin, which just previously received the tenth and last sheet in a set, is in position to be unloaded by the jaws 120, as shown in FIG. 4(*a*). The tenth and ninth bins will be loaded as the eleventh bin is unloaded, and so on. The logic in the programmer P is arranged to convey the last sheets of the copy sets in this manner and unload the bins as the array 102 indexes downwardly. The sensor S-1 in cooperation with the programmer clock and the operator preset reproduction run program will determine when the last sheets have arrived so as to control the downward indexing activity. The programmer will also control the actuation of the deflector 103 since not all of the upper deflectors will be utilized to load the last page ten of the copy sets. For instance, one or more lower deflectors can be utilized since the array is indexing downwardly and the few uppermost deflectors will not be aligned with a corresponding bin.

This sequence is continued until page ten has been delivered to all bins. As shown in FIG. 4(*b*), at this point, six of the twelve bins have been unloaded and new pages numbered one of the second block of copy sets to be reproduced are being loaded into the empty bins, starting in the bottom bin by using the bottommost deflector 103. When the array is in the position shown in FIG. 4(*b*) to start receiving new first pages of the next block of copy sets, the document handling apparatus 12 has already removed from the platen the document sheet corresponding to page one of the document, and has fed the second document sheet corresponding to page two of the document upon the platen for reproduction of the next twelve copy sheets corresponding to page two of the second block of copy sets. In this operation, it is assumed the reproduction system has been programmed for simplex copying, that is, one sided copying. Since there are a number of images being processed in the processor 11, in our example, twelve sheets in the paper path being conveyed by the various transports, two document sheet changes would have occurred earlier than the time that the last copy sheet indicative thereof is received in the bins 100.

As the array 102 continues indexing downwardly from the position shown in FIG. 4(*b*) to unload the copy sets still remaining, page one of the second block of copy sets is being loaded into the bins. In doing so, the bottommost or the last six deflectors 103 are utilized in sequence as the topmost deflectors become ineffective as the corresponding bins descend accordingly. When the array reaches its lowermost position as shown in FIG. 4(*c*), bin numbered one is unloaded and the last page one is about to be loaded therein. After the last page one is loaded into the array as shown in FIG. 4(*c*), the array is indexed upwardly and in doing so will receive page two of the copy sheets and some of the bins will receive page three as the array reaches its topmost position. Preferably, the programmer P is arranged to control the use of only two or three of the deflectors 103 in moving from the position of FIG. 4(*c*) to that of FIG. 4(*a*) as the upper deflectors become once more in operating position relative to the bins.

After the bin array 102 reaches its topmost position, the upper twelve deflectors are now utilized to sort or collate the remaining pages of the second block of copy sets while the array remains stationary, as shown in FIG. 4(*a*). After the tenth page is loaded into the first bin (lowermost) as in FIG. 4(*a*), this bin is unloaded and the array commences to index downwardly to effect the final unloading of the sets from the array.

In moving from the position of FIG. 4(*a*) to the position of FIG. 4(*c*), so as to unload the second block of copy sets and after the last sheet or page ten in the example has been loaded, a third block of twelve copy sets may begin immediately to be received in the array as aforesaid. In our example, however, only twenty-four copy sets are to be reproduced which results in the array remaining in the position as shown in FIG. 4(*c*). The programmer P may be devised to allow the array to remain in this position for the use of an operator in a subsequent production run or, after a suitable time period, automatically returns the array to the position shown in FIG. 4(*a*).

FIG. 5 is a block diagram of a control arrangement for the reproduction system in FIG. 1. The programmer P is operatively connected to four remotes: (1) the processor 11 for controlling the xerographic processing, copy sheet movement, timing and monitoring and all other parameters in the processor; (2) the input station comprising the flash illumination system circuitry; (3) the automatic document handling apparatus 12; and (4) the finishing station 13.

The finishing station 13 includes three drives, one of which is operatively connected by way of relays or reediac to the elevator motor. Another driver is operatively connected to a servo controller which, in turn, is connected to two power amplifiers and associated circuitry. The third driver is operatively connected to the sorter gates 103 by way of their actuating solenoids (not shown) and the unloading bin gates 130. One of the power amplifiers serves to energize and operate the sorter array index motor M-1, while the other amplifier serves to energize and operate the set transport motor M-2. One of the power amplifiers also is operatively connected to the staple drive system, the stapler clamping system and the stapler clinching system as well as the valve 128.

From the foregoing it will be apparent that an electrostatographic system with finishing station has been described which will produce stapled collated sets and unstapled sets or stacks at a high production rate without loss of throughput, at a rate in accordance with the full processing speed of the copy processing machine and with a minimum of wear and fatigue of the moving parts.

While the invention has been described with reference to the structure disclosed, it is not confined to the details set forth but is intended to cover such modifications or changes which may come within the scope of the following claims.

I claim:

1. In a reproduction system having a processor for reproducing information to be copied on copy sheets and to transport the copy sheets to an exit point, the improvement including:

an array of sheet collecting bins adapted to receive copy sheets and to collate the same into sets of copies of different images, sheet transport means positioned on one side of said array for directing copy sheets into said bins along said side, said sheet transport means including means for receiving copy sheets from the processor at the exit point, a finishing apparatus arranged to receive the collated sets of copy sheets from the collecting bins of said array, and a set transport mechanism arranged adjacent said array of bins and adapted to receive sequentially the collated sets from each of the bins in said array at a fixed collection point, and to transport the same to said finishing apparatus for a binding operation, said transport mechanism being mounted for pivotal movement between said collection point and said finishing station.

2. In a reproduction system having a processor for reproducing information to be copied on copy sheets and to transport the copy sheets to an exit point, the improvement comprising:

a single array of sheet collecting bins adapted to receive copy sheets and to collate the same into sets of copies of different images, sheet transport means positioned on one side of said array for directing copy sheets into said bins along said side, said sheet transport means including means for receiving copy sheets from the processor at the exit point, a finishing apparatus arranged to receive the collated sets of copy sheets from the collecting bins of said array, and a set transport mechanism arranged on the side of said array opposite that of said transport means and adapted to receive the collated sets from each of the bins in said array, and to transport the same to said finishing apparatus for a binding operation, and means for producing relative motion between said array and said set transport mechanism to permit the unloading of copy sets from said array, and control means operatively associated with said sheet transport means and said set transport mechanism for controlling the loading of copy sheets in said array simultaneously with the unloading of copy sets therefrom.

3. In a reproduction system having a processor for reproducing information to be copied on copy sheets and means for producing the information in the form of an individual light image for each copy sheet, each light image being produced a predetermined number of times in succession before a different succeeding light image is produced the same predetermined number of times, the improvement including:

an array of sheet collecting bins adapted to receive copy sheets and to collate the same into sets of copies of different images, a finishing apparatus arranged to receive the collated sets of copy sheets from the collecting bins of said array, sheet transport means positioned on one side of said array for sequentially transporting copy sheets into said bins for collating the same into copy sets, and a set transport mechanism arranged on the side of said array of bins opposite that of said transport means and adapted to receive sequentially the collated sets from each of the bins in said array at a fixed collection point, and to transport the same to said finishing apparatus for a binding operation, said set transport being mounted for pivotal movement between said collection point and said finishing station.

* * * * *